US008555904B1

(12) United States Patent
Lai

(10) Patent No.: US 8,555,904 B1
(45) Date of Patent: Oct. 15, 2013

(54) UMBRELLA STAND THAT IS MOVABLE ON THE GROUND

(75) Inventor: Jin-Sheng Lai, Taipei (TW)

(73) Assignee: Galtech Computer Corp., Newbury Park, CA (US)

( * ) Notice: Subject to any disclaimer, the term of this patent is extended or adjusted under 35 U.S.C. 154(b) by 30 days.

(21) Appl. No.: 13/425,462

(22) Filed: Mar. 21, 2012

(51) Int. Cl.
*A45B 25/00* (2006.01)
*F16M 13/00* (2006.01)

(52) U.S. Cl.
USPC ..... 135/16; 135/21; 135/98; 248/129; 248/519; 248/346.11

(58) Field of Classification Search
USPC ..... 135/16, 98, 99, 20.1, 21, 85, 912, 903; 248/544, 545, 156, 125.8, 129, 219, 248/519, 522, 910, 346.11; 473/483, 484
See application file for complete search history.

(56) References Cited

U.S. PATENT DOCUMENTS 2,783,055 A * 2/1957 Michaud ..... 280/43.14
4,412,679 A * 11/1983 Mahoney et al. ..... 473/483
4,417,738 A * 11/1983 Kendall ..... 280/43.17
5,039,109 A * 8/1991 Mahoney et al. ..... 473/435
5,220,740 A * 6/1993 Brault ..... 40/606.02
5,429,378 A * 7/1995 Durel-Crain ..... 280/43.22
6,305,659 B1 * 10/2001 Metelski ..... 248/519
6,367,494 B1 * 4/2002 Tung ..... 135/99
6,412,746 B2 * 7/2002 Davis et al. ..... 248/519
6,637,717 B2 * 10/2003 Li ..... 248/519
7,431,259 B2 * 10/2008 Tung ..... 248/521
7,513,479 B2 * 4/2009 Li ..... 248/519

* cited by examiner

*Primary Examiner* — Winnie Yip
(74) *Attorney, Agent, or Firm* — Alan Kamrath; Kamrath IP Lawfirm, P.A.

(57) ABSTRACT

An umbrella stand includes a housing and an operation mechanism mounted on the housing. The operation mechanism includes a support frame mounted in the housing and having two receiving slots, two mounting plates each pivotally mounted on the support frame, two pivot shafts each mounted in the support frame and each extended through a respective one of the mounting plates, two castors each rotatably mounted on a respective one of the mounting plates, two mounting tubes secured on the support frame, a driven rod rotatably mounted in the mounting tubes, two pressing plates secured on the driven rod and each pressing a respective one of the mounting plates, and a control handle connected with the driven rod to rotate the driven rod. Thus, the housing is movable freely on the ground by operation of the operation mechanism.

9 Claims, 5 Drawing Sheets

UMBRELLA STAND THAT IS MOVABLE ON THE GROUND

BACKGROUND OF THE INVENTION

1. Field of the Invention

The present invention relates to a stand and, more particularly, to an umbrella stand.

2. Description of the Related Art

A conventional umbrella of a larger size comprises a stand placed on the ground, and a skeleton mounted on and supported by the stand. However, the conventional umbrella has a larger volume and heavier weight so that the conventional umbrella cannot be moved easily, thereby causing inconvenience to the user when wishing to move the conventional umbrella.

BRIEF SUMMARY OF THE INVENTION

In accordance with the present invention, there is provided a umbrella stand, comprising a housing and an operation mechanism mounted on the housing. The operation mechanism includes a support frame mounted in the housing and having two receiving slots formed in two opposite ends thereof, two mounting plates each pivotally mounted on the support frame and each aligning with a respective one of the receiving slots of the support frame, two pivot shafts each mounted in the support frame and each extended through a respective one of the mounting plates so that each of the mounting plates is pivotally attached to the support frame, two castors each rotatably mounted on a respective one of the mounting plates, two mounting tubes secured on the support frame, a driven rod rotatably mounted in the mounting tubes, and two pressing plates secured on two opposite ends of the driven rod to rotate in concert with the driven rod and each pressing a respective one of the mounting plates. The operation mechanism further includes a control handle connected with the driven rod to rotate the driven rod.

The primary objective of the present invention is to provide an umbrella stand that is movable on the ground.

According to the primary advantage of the present invention, the housing is movable freely on the ground by operation of the operation mechanism so that a user can move the umbrella stand easily and quickly.

According to another advantage of the present invention, each of the castors is swiveled and rotated through 360 degrees to facilitate the user moving the umbrella stand.

According to a further advantage of the present invention, the user only needs to drive the control handle so as to lift and move the housing so that the umbrella stand is operated easily and conveniently.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
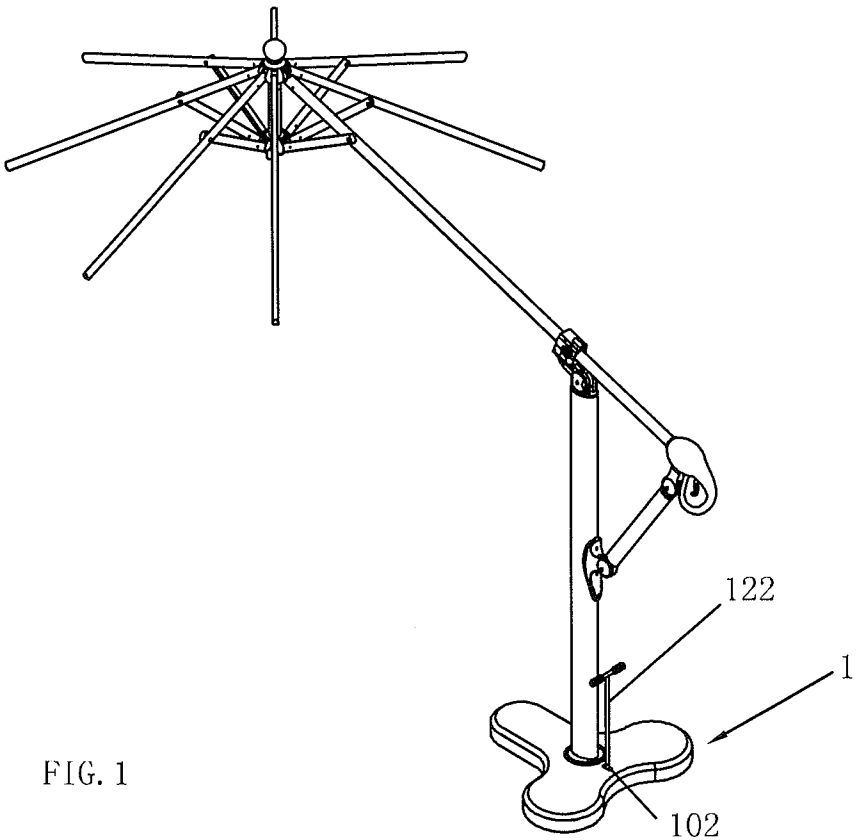
FIG. 1 is a perspective view of an umbrella stand in accordance with the preferred embodiment of the present invention.

Referring to the drawings and initially to FIGS. 1-4, an umbrella stand in accordance with the preferred embodiment of the present invention comprises a housing 1 and an operation mechanism 10 mounted on the housing 1.

The housing 1 has a top provided with an exposing slot 102 and a bottom provided with an opening 100.

The operation mechanism 10 includes a support frame 11 mounted in the housing 1 and having two receiving slots 111 formed in two opposite ends thereof, two mounting plates 131 each pivotally mounted on the support frame 11 and each aligning with a respective one of the receiving slots 111 of the support frame 11, two pivot shafts 132 each mounted in the support frame 11 and each extended through a respective one of the mounting plates 131 so that each of the mounting plates 131 is pivotally attached to the support frame 11, two castors 13 each rotatably mounted on a respective one of the mounting plates 131, two mounting tubes 112 secured on the support frame 11, a driven rod 12 rotatably mounted in the mounting tubes 112, two pressing plates 121 secured on two opposite ends of the driven rod 12 to rotate in concert with the driven rod 12 and each pressing a respective one of the mounting plates 131, and a control handle 122 connected with the driven rod 12 to rotate the driven rod 12.

Each of the mounting plates 131 is exposed from the respective receiving slot 111 of the support frame 11. Each of the mounting plates 131 has a first end pivotally connected with a respective one of the pivot shafts 132 and a second end pressed by a respective one of the pressing plates 121. Each of the mounting plates 131 is pivoted about the respective pivot shaft 132 and is moved downward relative to the support frame 11 when each of the mounting plates 131 is pressed by the respective one of the pressing plates 121.

Figure 4:
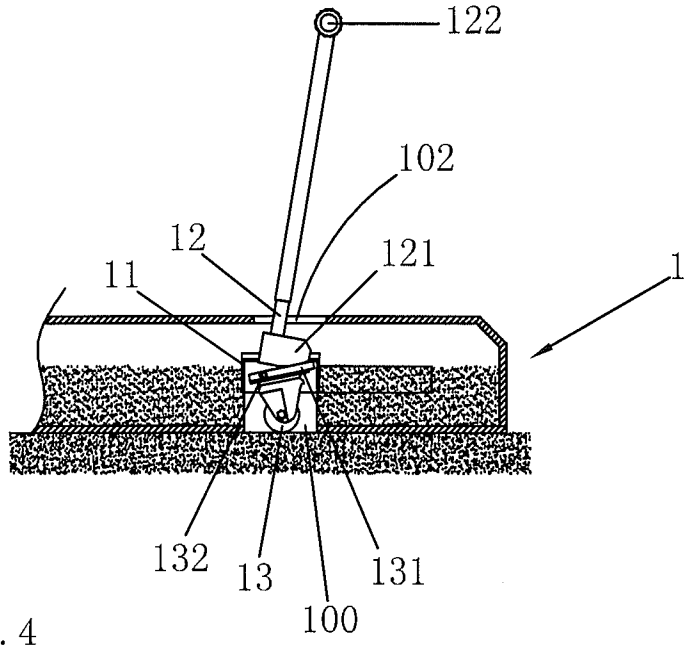
FIG. 4 is a partially side cross-sectional view of the umbrella stand as shown in FIG. 1.
Figure 5:
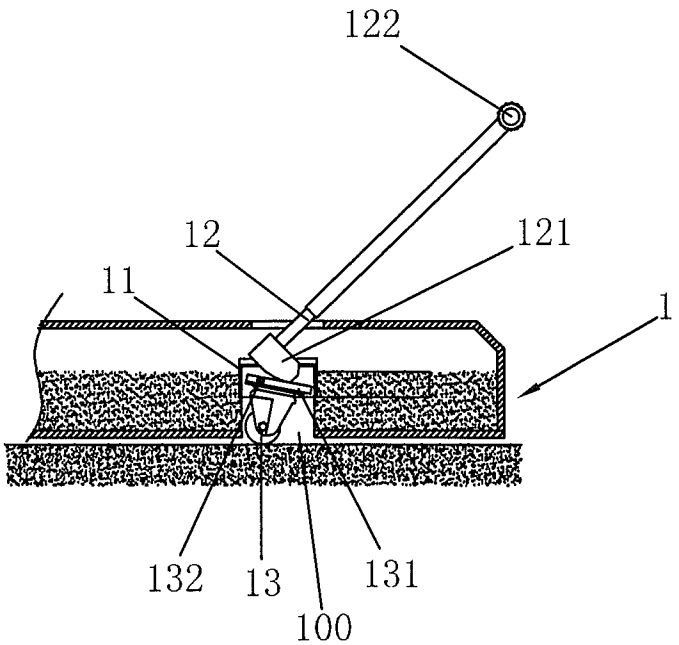
FIG. 5 is a schematic operational view of the umbrella stand as shown in FIG. 4 in use.

Each of the castors 13 protrudes outward from a bottom of the support frame 11. Each of the castors 13 is movable in concert with the respective mounting plate 131 between a first position as shown in FIG. 4, where each of the castors 13 is retracted into the opening 100 of the housing 1, and a second position as shown in FIG. 5, where each of the castors 13 is protruded outward from the opening 100 of the housing 1.

Each of the pressing plates 121 is protruded outward from the mounting tubes 112 and is movable in a respective one of the receiving slots 111 of the support frame 11.

The mounting tubes 112 are spaced from each other with a gap 113 being defined between the mounting tubes 112.

The control handle 122 is extended through the gap 113 between the mounting tubes 112 and is extended through the exposing slot 102 of the housing 1. The control handle 122 has a lower end connected with the driven rod 12 and an upper end protruded outward from the exposing slot 102 of the housing 1.

Figure 2:
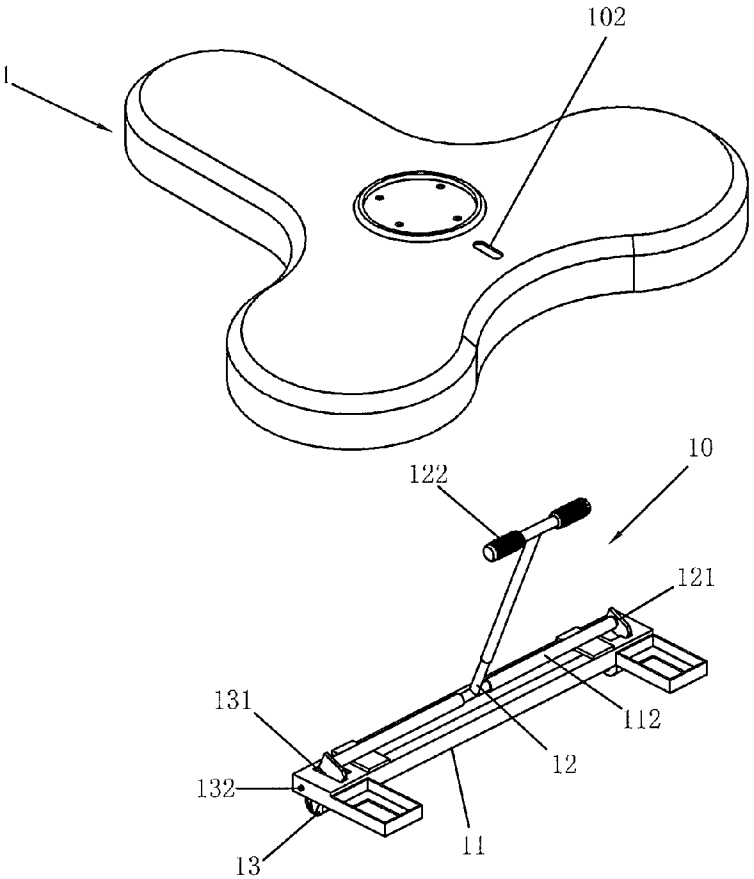
FIG. 2 is a partially exploded perspective view of the umbrella stand as shown in FIG. 1.
Figure 3:
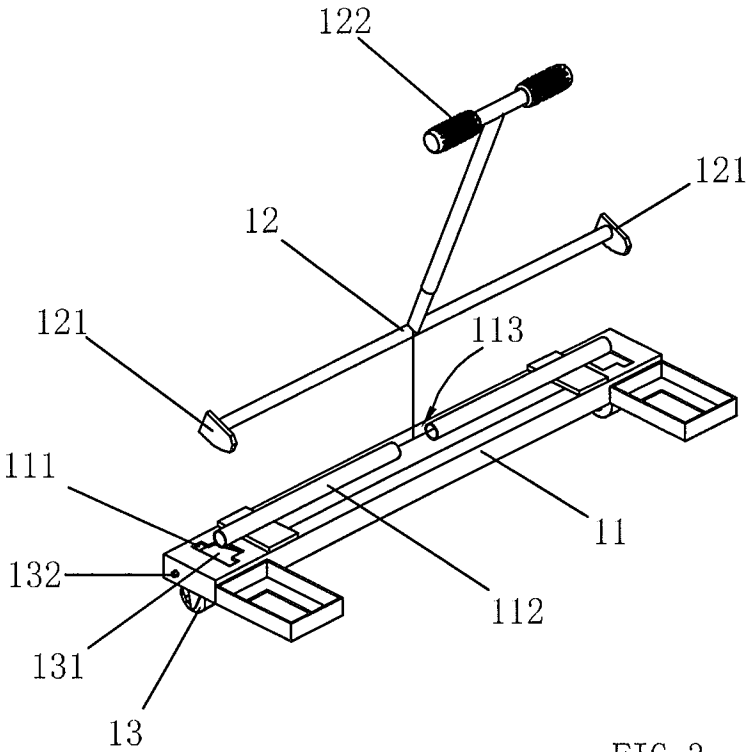
FIG. 3 is a partially exploded perspective view of the umbrella stand as shown in FIG. 2.

In operation, referring to FIGS. 4 and 5 with reference to FIGS. 1-3, when the control handle 122 moved downward, the driven rod 12 is driven by the control handle 122 to rotate the pressing plates 121 so that the pressing plates 121 are pivoted downward to press the mounting plates 131 downward. In such a manner, each of the mounting plates 131 is pivoted downward about the respective pivot shaft 132 and is moved downward relative to the support frame 11 when each of the mounting plates 131 is pressed by the respective one of the pressing plates 121, so that each of the castors 13 is moved downward in concert with the respective mounting plate 131 and is protruded outward from the opening 100 of the housing 1 as shown in FIG. 5. In such a manner, each of the castors 13 abuts the ground and is subjected to a force from the ground. Thus, the housing 1 is lifted when each of the castors 13 is protruded outward from the opening 100 of the housing 1 to abut the ground so that the housing 1 is movable freely on the ground by rotation of the castors 13.

After the housing 1 is moved to a determined position, the control handle 122 moved upward, and the driven rod 12 is driven by the control handle 122 to rotate the pressing plates 121 so that the pressing plates 121 are pivoted upward to release the mounting plates 131. In such a manner, each of the castors 13 is pushed upward by the reaction of the ground and by the gravity of the housing 1 so that each of the mounting plates 131 is pivoted upward about the respective pivot shaft 132 and is moved upward relative to the support frame 11, and each of the castors 13 is retracted into the opening 100 of the housing 1 as shown in FIG. 4.

Accordingly, the housing 1 is movable freely on the ground by operation of the operation mechanism 10 so that a user can move the umbrella stand easily and quickly. In addition, each of the castors 13 is swiveled and rotated through 360 degrees to facilitate the user moving the umbrella stand. Further, the user only needs to drive the control handle 122 so as to lift and move the housing 1 so that the umbrella stand is operated easily and conveniently.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An umbrella stand, comprising:

a housing having a bottom provided with an opening; and an operation mechanism mounted on the housing;

wherein the operation mechanism includes:

a support frame mounted in the housing and having two receiving slots formed in two opposite ends thereof;

two mounting plates each pivotally mounted on the support frame and each aligning with a respective one of the receiving slots of the support frame;

two pivot shafts each mounted in the support frame and each extended through a respective one of the mounting plates so that each of the mounting plates is pivotally attached to the support frame;

two castors each rotatably mounted on a respective one of the mounting plates;

two mounting tubes secured on the support frame;

a driven rod rotatably mounted in the mounting tubes; and two pressing plates secured on two opposite ends of the driven rod to rotate in concert with the driven rod and each pressing a respective one of the mounting plates; and wherein each of the castor is movable in concert with the respective mounting plate between a first position where each of the castors is retracted into the opening of the housing, and a second position where each of the castors is protruded outward from the opening of the housing.

2. The umbrella stand of claim 1, wherein the operation mechanism further includes a control handle connected with the driven rod to rotate the driven rod.

3. The umbrella stand of claim 1, wherein each of the mounting plates is exposed from the respective receiving slot of the support frame.

4. The umbrella stand of claim 1, wherein each of the mounting plates has a first end pivotally connected with a respective one of the pivot shafts and a second end pressed by a respective one of the pressing plates.

5. The umbrella stand of claim 4, wherein each of the mounting plates is pivoted about the respective pivot shaft and is moved downward relative to the support frame when each of the mounting plates is pressed by the respective one of the pressing plates.

6. The umbrella stand of claim 1, wherein each of the pressing plates is protruded outward from the mounting tubes.

7. The umbrella stand of claim 1, wherein each of the pressing plates is movable in a respective one of the receiving slots of the support frame.

8. The umbrella stand of claim 2, wherein the housing has a top provided with an exposing slot;

the mounting tubes are spaced from each other with a gap being defined between the mounting tubes;

the control handle is extended through the gap between the mounting tubes and is extended through the exposing slot of the housing.

9. The umbrella stand of claim 8, wherein the control handle has a lower end connected with the driven rod and an upper end protruded outward from the exposing slot of the housing.

* * * * *